US006776678B2

(12) United States Patent
Courtney

(10) Patent No.: US 6,776,678 B2
(45) Date of Patent: Aug. 17, 2004

(54) INTEGRATED OR ATTACHED SPACE OCCUPYING CEPHALIC RESTRAINT COLLAR FOR IMPROVED LIFE JACKET PERFORMANCE

(76) Inventor: William H. Courtney, 1990 Highway One, Elk, CA (US) 95432

( * ) Notice: Subject to any disclaimer, the term of this patent is extended or adjusted under 35 U.S.C. 154(b) by 0 days.

(21) Appl. No.: 10/021,519

(22) Filed: Dec. 7, 2001

(65) Prior Publication Data

US 2002/0072287 A1 Jun. 13, 2002

Related U.S. Application Data

(60) Provisional application No. 60/254,380, filed on Dec. 8, 2000.

(51) Int. Cl.[7] ..... B63C 9/08

(52) U.S. Cl. ..... 441/123

(58) Field of Search ..... 441/123, 124, 441/88; 128/DIG. 23; 602/18

(56) References Cited

U.S. PATENT DOCUMENTS

| | | | | | |
|---|---|---|---|---|---|
| 2,893,020 | A | * | 7/1959 | Miller | 441/116 |
| 3,750,205 | A | * | 8/1973 | Pfeifer | 441/123 |
| 3,921,626 | A | * | 11/1975 | Neel | 602/18 |
| 4,051,568 | A | * | 10/1977 | Strolenberg | 441/116 |
| 4,205,667 | A | * | 6/1980 | Gaylord, Jr. | 602/18 |
| 4,622,018 | A | * | 11/1986 | Blanc | 441/123 |
| 4,800,871 | A | * | 1/1989 | Florjancic | 602/18 |
| 5,048,509 | A | * | 9/1991 | Grundei et al. | 602/18 |
| 5,060,661 | A | * | 10/1991 | Howard | 128/845 |
| 5,152,706 | A | * | 10/1992 | Fister | 441/106 |
| 5,249,999 | A | * | 10/1993 | Steger | 441/118 |
| 5,775,967 | A | * | 7/1998 | Lacoursiere et al. | 441/115 |
| 5,785,670 | A | * | 7/1998 | Hiebert | 602/18 |
| 5,839,932 | A | * | 11/1998 | Pierce et al. | 441/80 |
| 6,062,929 | A | * | 5/2000 | Hallstrom | 441/106 |
| 6,260,199 | B1 | * | 7/2001 | Grunstein et al. | 2/69 |
| 6,328,618 | B1 | * | 12/2001 | Fleischli | 441/106 |
| 6,379,208 | B2 | * | 4/2002 | Khanamirian | 441/106 |
| 6,458,090 | B1 | * | 10/2002 | Walpin | 602/18 |

FOREIGN PATENT DOCUMENTS

| | | | | |
|---|---|---|---|---|
| FR | 2472506 | * | 7/1981 | 441/123 |

OTHER PUBLICATIONS

Co–pending U.S. patent application Ser. No. 09/935,351, filed Aug. 22, 2001, entitled: Garment Integrated Multi–Chambered Personal Flotation Device or Life Jacket. Applicant: William L. Courtney.

* cited by examiner

*Primary Examiner*—Andrew Wright
(74) *Attorney, Agent, or Firm*—Daniel S. Polley, P.A.

(57) ABSTRACT

An integrated or attached (built in or retrofitted) space occupying (fills space beneath the chin) cephalic restraint collar (holds the head in the axis of rotation) for improved personal flotation device ("PFD") performance. The restraint assists with aligning and securing the head and neck in line with the axis of rotation. In this position the ballast of the head is divided evenly about the axis of rotation negating its ability to oppose effective rotation. The cephalo-cervical restraint improves the efficacy of all PFD designs elements targeting turning. By guiding the head into a cylindrical notch in the posterior cervical foam behind the victim's head the head is then aligned along the axis of rotation where the heads 14–17 pounds of ballast is symmetrically distributed about that axis. Therefore, whatever eccentric forces are applied in the generation of angular acceleration or torque, do not have to overcome the offsetting effects of the heads ballast acting as a mobile ballast element. Preferably, the collar has soft inner fabric for comfort and warmth.

8 Claims, 6 Drawing Sheets

INTEGRATED OR ATTACHED SPACE OCCUPYING CEPHALIC RESTRAINT COLLAR FOR IMPROVED LIFE JACKET PERFORMANCE

This application claims the benefit of and priority to U.S. application Ser. No. 60/254,380, filed Dec. 8, 2000.

BACKGROUND OF THE INVENTION

1. Field of the Invention

The present invention relates to improving the inherently buoyant Life Jacket's ability to roll the flaccid, unconscious victim, from an airway-submerged face down position into an airway protected face up position.

2. Description of the Prior Art

Currently inherently buoyant Life Jackets are sized to fit all adults. Due to their rigidity, the foam personal flotation device ("PFD") that can accommodate a 300 lb. adult is loose on a 100 LB adult. Consequently when a large percentage of adults lose consciousness, and thus muscular tension in the cervical spinal muscles, the head is free to act under the influence of gravity where it falls forward or to the side totally dependent upon PFD positioning. The head represents 14–17 lbs. of ballast that is more than capable of overpowering the PFD's best efforts to roll the victim from face down to face up.

One current example of the consequences of cephalic dominated surface positioning is that in a single commercial boating accident this last year 16 people drowned while wearing Life Jackets. 50% drowned because their PFD failed to turn them from face down to face up while the other 50% drown after they slipped partially out of their Life Jackets. The variably sized cephalic restraint disclosed herein directly remedies both these deficiencies.

The synergistic application of eccentric ballast and buoyancy in the production of a reliable heads up positioning of the flaccid unconscious victim lost at sea requires that the Life Jacket firmly yet without compression control the positioning of the victim's head and neck. Since the head typically weighs 14–17 pounds when held out of the water, the eccentric ballast of the victim's head draped off to one side exceeds the applied eccentric airway protective buoyancy and ballast by a factor of 7 to 17 fold. As the PFD attempts to roll the unconscious victim from a face down airway submerged position where the head is submerged its ballast impacting PFD performance is minimal out of the water, the impact of the eccentric head opposes the rotation about the axis in ever increasing fashion. Often as the head surfaces its ballast eventually grinds the rescue rotation to a halt just shy of adequate surface positioning.

The ability of the combined set of forces acting upon the unconscious victim, in particular the upward force of eccentric buoyancy and the downward force of eccentric ballast, to produce their optimal angular acceleration depends on where and how the force is applied and upon what resistances develop opposing those rotational forces. Until the present invention, described below, testers to varying degree, through their choice of tests and through their musculature rigidity, assisted the PFD in appearing to pass to the 5 second turning test. The current international standard three stroke turning test, allows the tester to utilize numerous skeletal muscles that result in the tester oscillating about their axis of rotation as they perform the three strokes immediately prior to 'feigning unconsciousness'. The forward velocity generated by the three strokes buffets the head and forward aspects of the PFD contributing initiating angular acceleration creating instability in the tester-PFD system. Secondary to various tester contributions many PFDs are "Tested and Approved" to the 5 second turning test but are susceptible to failure in the real world where the victim is either uninformed or unable to take the necessary three strokes immediately prior to loss of consciousness.

In many if not most test situations the tester can compensate for minimal to marked deficiencies in the airway protective capacity of the tested PFD, without such contrived testing there would be little if any product passed.

SUMMARY OF THE INVENTION

Previous applications by this inventor discussed the role of eccentric ballast and buoyancy. However, it is also important to reliably control the PFD user's head. As the PFD tester improves their ability to more thoroughly feigns unconsciousness, as the PFD begins to roll the tester from face down into the first 90 degree segment of axial rotation, the completely relaxed neck allows the head which has fallen forward under its own weight to roll long the victim's chest toward the side. At 90 degrees, with the arms, legs and head to one side and a large portion of the PFD and opposite pulmonary field high out of the water the victim's enters a second stable surface position the side high airway submerged position. Currently with the slightest residual tension in the testers neck, the PFD will appear to roll the tester through the side high position and over onto their back with their nose and mouth free and clear. Unfortunately the truly unconscious victim is incapable of such product assistance and in its absence ends up floating on their side with their airway submerged.

The current invention serves to align and then secure the head and neck in line with the bodies/PFDs axis of rotation. In this position the ballast of the head is divided evenly about the axis of rotation negating its ability to oppose the PFD's forces being applied in the generation of rotational torque.

Once the range of motion of the victim's head is controlled, the PFD with integrated space occupying cephalic restraint means of the present invention, is able to reliably and consistently effect Active Self Rescue. Active Self Rescue is defined as; when the PFD alone, without any assistance from the victim, is able to roll the unconscious victim's face free of the water, within the 5 seconds required by international standards.

DESCRIPTION OF THE PREFERRED EMBODIMENTS

Figure 1:
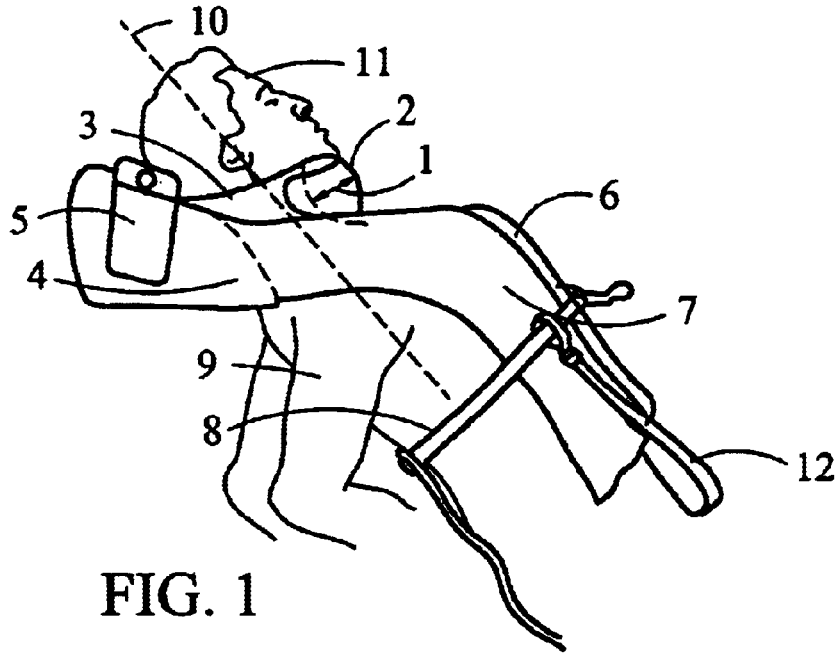
FIG. 1 is a right lateral view demonstrating overlapping components of an adjustably sized cephalo-cervical restraint.

A majority of clothing, from dinner jackets to shirts, are chosen incrementally by neck size, yet Life Jackets as currently supplied are 'One size fits all'. Until now if the inherently buoyant Life Jacket is constructed to accommodate a muscular 20" neck it will inevitably be loose on an individual with a 13" neck.

Due to the rigidity of the foam often used in the manufacture of PFDs, the PFDs have to be sized to fit the larger of the intended wearers. Since the adult size has to cover everyone larger than a child, it must be large enough to fit the large adult, consequently the small framed male or female has considerable space around their neck. Between the oversized circumference and the connected anterior entrance opening in the front of the vest the flaccid head and neck have access to an excessive range of motion. The outcome of a loose fit is that the ballast of the unconscious victim's head overpowers the traditional PFD's buoyancy and creates multiple airway submerged surface positions.

The disclosed inclusion provides a space occupying, flexible foam mandibular-cervical collar whose length can be adjusted 46, 47 to conform to a wide range of adult anatomy whether they are a 90 LB or a 300 LB individual. This personalization of fit is critical to the self-rescue function of the Life jacket. Restating, if the head and neck are not adequately restrained and located along the axis of rotation FIG. 1, the excessive ballast of the head that drops down and or to the side FIG. 2 is capable of overriding the turning torque of the Life Jacket. Through the use of an space occupying, adjustable, flexible collar 2, 3 the neck while enclosed is not compressed. The neck orifice in the PFD has now been reduced so that the head cannot pass through and the space from the back of the jaw to the front is occupied with material of sufficient durometer that the head cannot compress or collapse it. In such a design the wearer is comfortable, the airway is without compromise, yet the PFD maintains uncompromised control of the sizable ballast contributed by a head held out of the water. While the overlapping adjustable mandibular cervical collar can be comprised of spun fiber or open cell foam because its displacement is not critical, since in the operative position the wearer's neck is out of the water, a reasonably stiff yet flexible closed cell foam is preferred as it enhances the net buoyancy in certain positions and sheds water thereby conferring additional thermal protection. The use of variable securing means 46, 47 such as hook and loop fastening members allows the wearer to uniquely adjust both the diameter and height of the mandibular—cervical restraint. With the head of the victim comfortably and securely positioned, the torque needed to roll the wearer from an airway submerged into and airway protected position is significantly reduced, improving wear ability and therefore compliance. The reduction in the amount of net buoyancy, eccentric buoyancy and ballast results in a smaller Life Jacket acquiring an improved capacity for Self Rescue previously unobtainable even in larger PFDs. It is widely accepted that as the size of a PFD is reduced, comfort is increased. Increased comfort converts directly into improved compliance, the real world touchstone for improved Safety Of Life At Sea("SOLAS").

Figure 7:
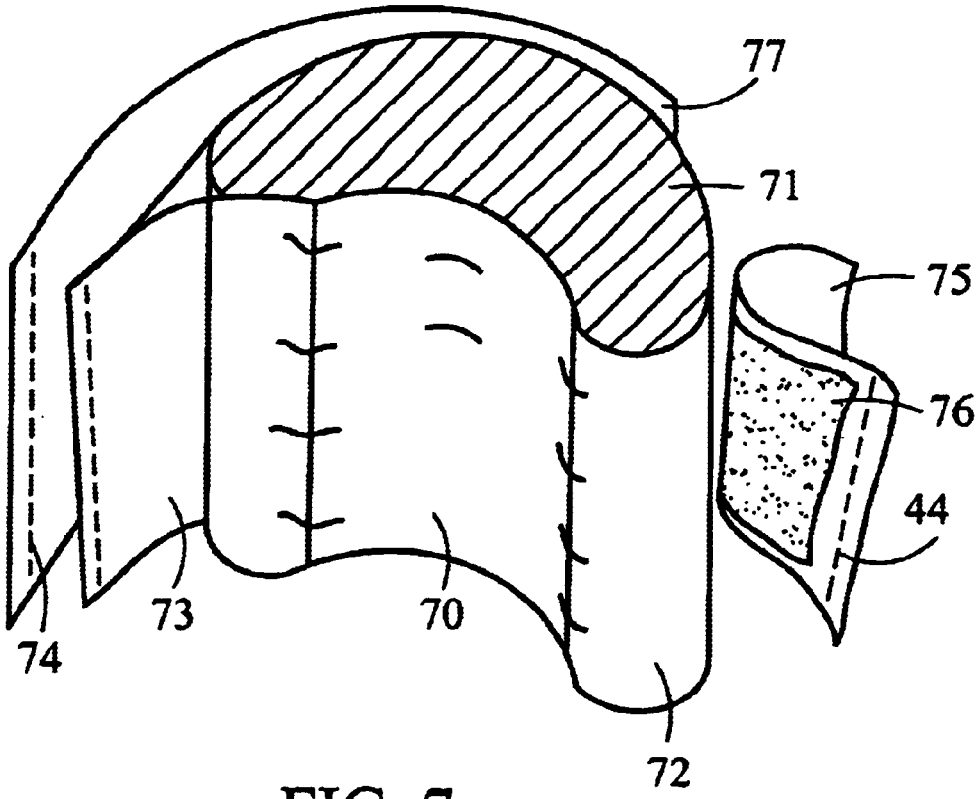
FIG. 7 is a superior posterior view of a solid cephalo-mandibular splint with hollow tracheal space protecting wind pipe.
Figure 8:
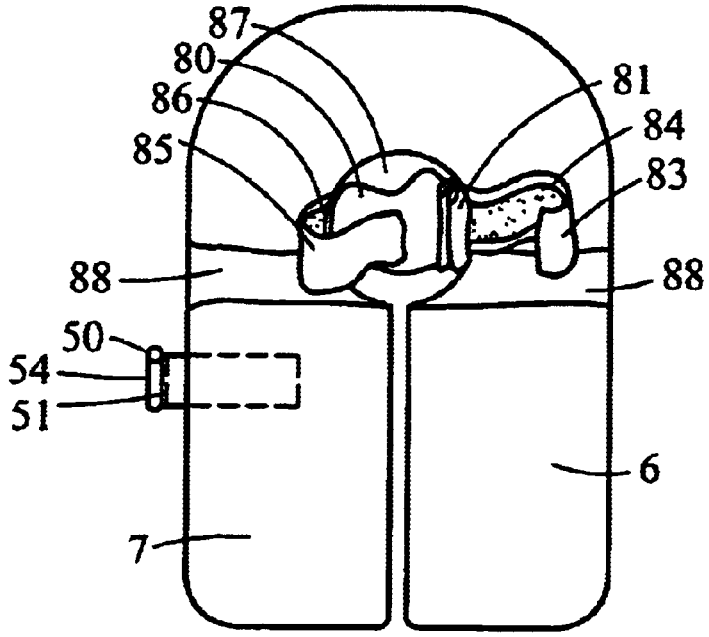
FIG. 8 is an anterior view of a compact cephalo-mandibular restraint means stowed within the PFD neck opening, as the incorporated hinge opening preferably requires inferior ballast placement.
Figure 9:
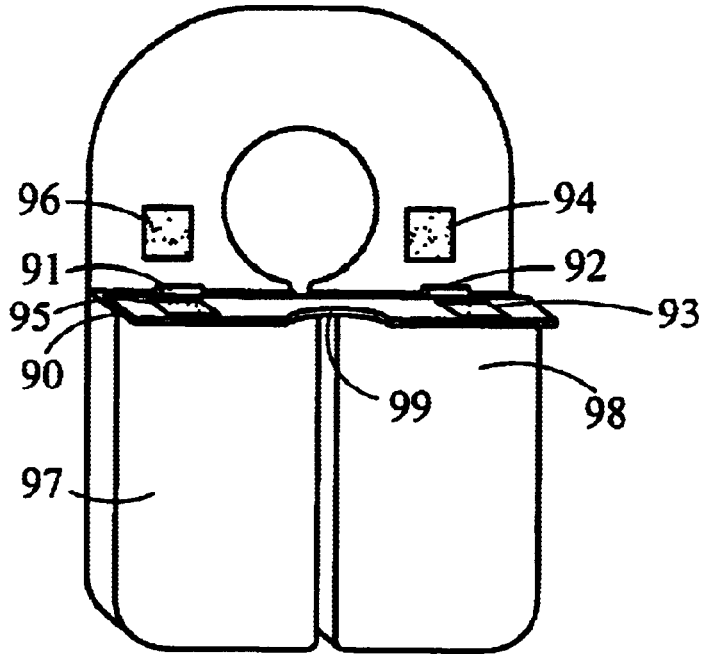
FIG. 9 is an anterior ¾ view of alternate compact stowage configuration for the cephalo-mandibular restraint, loosely attached to the PFD, the restraint stows flat against the body of the ventral arms.

For PFDs constructed to fit within existing lockers a single piece splint 72 with a solid shelf to support the mandible 71 can be attached by a loose arm 73 through stitching to the neck of the PFD at 74 (FIG. 7). Once the cavity 70 is centered over the trachea the retaining means 75 and 77 are securely fastened by use of an adjustable closure means 76. As seen in FIG. 8, to facilitate stowage FIG. 8 the entire cephalo-mandibular splint stows within the neck opening of the PFD 80 to allow tight packing, an important issue for a vessel storing thousands of PFDs. The compact cepahlo-mandibular restraint is loosely attached to the PFD by a fabric hinge 81 and once located that position is secured by flaps 83 and 85 which mount adjustable closure means 84 and 86. Ideally the compact splint has a notch 87 to locate and comfortably accommodate the chin. As seen in FIG. 8 the fabric hinge preferably requires locating the eccentric ballast in the inferior position so as to not affect face plane.

Given the extreme pressures to reduce the bulk associated with the carriage of thousands of PFDs on a single vessel, the horizontally mounted compact cepahlo-mandibular splint 90 works well with PFD designs that have oversized lower ventral buoyant means 97 and 98. It also can be loosely attached to the PFD via hinge 91 and after adjusted to the individual is secured by variable closure means 93, 94, 95 and 96. A notch for the chin 99 helps to locate and secure the splint.

The cephalo-cervical restraint collar comprised of a one part restraint 70–76 or two parts 2 and 3 can be used independently to retrofit existing PFDs in the field by attaching the arms via two adjustable strap means to the bilateral cervical portions 67 of the pre-existing PFD by securing means such as by hook and loop fastening members 65, 66 or zippers, snaps, straps etc.

Similarly a very small orally inflatable cephalic restraint attached to an existing PFD can be used to restrain the range of motion of a flaccid victims head and neck.

Figure 2:
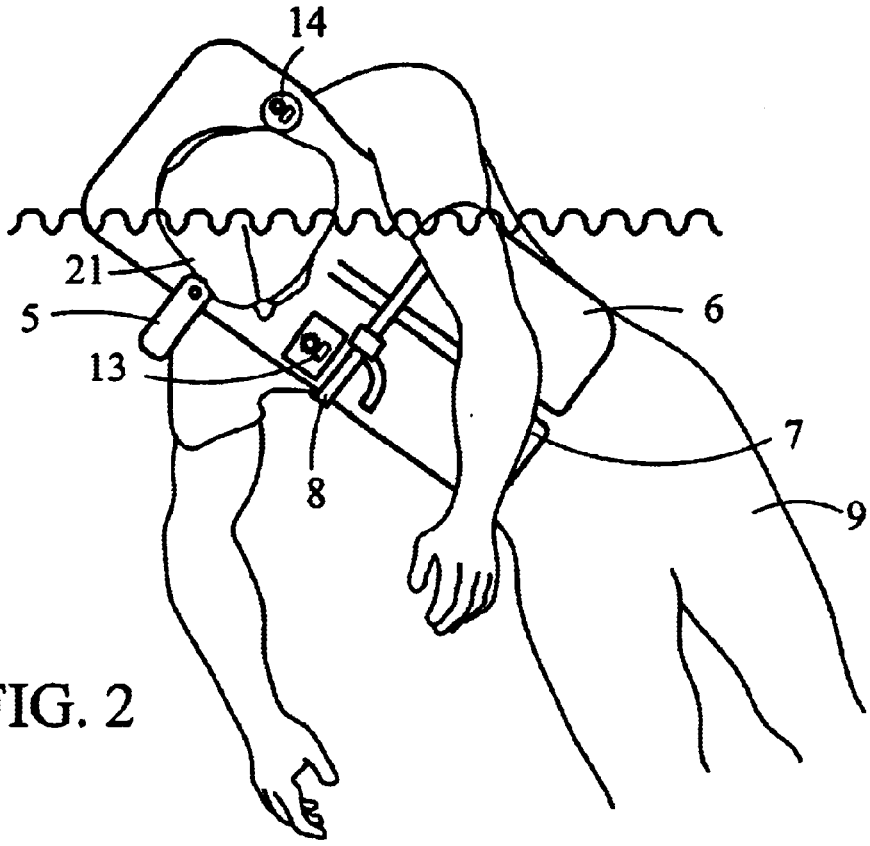
FIG. 2 is an anterior-lateral view of a victim floating in an airway submerged side high position despite wearing a PFD with significant eccentric buoyancy and ballast.

Complementing the adjustable anterior cephalo-cervical collar 2, is the posterior cervical foam of the PFD, which ideally is carved out, creating a rearward sloping cylindrical depression 4 (FIG. 1). This cylindrical depression guides the neck as it drops backward into this sculpted receptacle thereby assisting the wearer in correctly positioning the neck along the axis of rotation 10. Additionally, the central positioning and securing of the head and neck in a solitary central position achieves optimal freeboard by preventing the head from falling to either side as seen in FIG. 2 from which position the corner of the mouth becomes closer to or submerged by water. The complementary posterior cervical foam splint 4 receives and orients the neck facilitating the correct application of the right 3 and left 2 overlapping anterior mandibular 48—cervical 52 collars.

FIG. 7 shows an alternate embodiment of the cephalo-mandibular splint as a single piece solid foam block 72 built of glued layers or cast in a mold. While providing a solid support surface 71 for the inferior aspect of the mandible the solid walls create a hollow space 70 that envelops the throat protecting the thyroid cartilage and its cyclic movement as well as protecting the neck from any pressure by the collars securing means. The foam can be enveloped in a fabric cover 73 secured to the neck of the PFD 74. The other side of the PFD provides a closure means 76 attached to a flap 75 also secured to the PFD at 74. The single piece Cephalo-mandibular splint, illustrated in a posterior superior view in FIG. 7, can be sized to fit within the PFD neck opening. The splint can be loosely attached for variable sized positioning then secured by a separate set of closure means.

Figure 5:
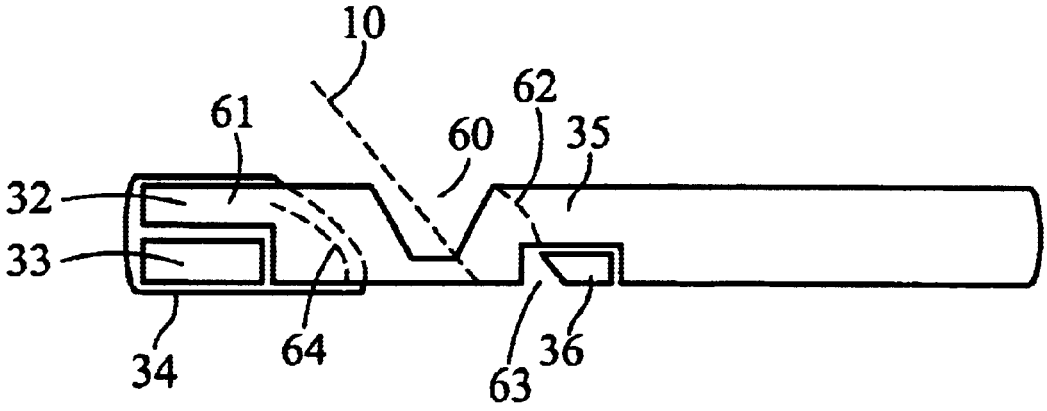
FIG. 5 is a right lateral view of a two part interdigitating solid foam PFD with cast cervical hinge means and sculpted posterior cervical receiver.
Figure 6:
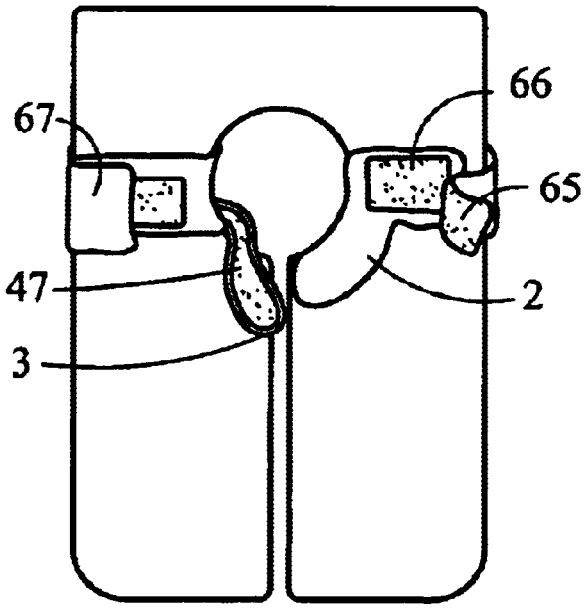
FIG. 6 is an anterior view of a PFD retrofitted with adjustable two part Cephalo-cervical restraint means.

Between the posterior cervical portion of the PFD and the ventral arms is a hinge section that serves a dual roll. To be stored in standardized PFD lockers mounted on many vessels the PFD optimally lies flat during storage. Once donned the vest must flex at the neck or it will force the individuals head forward both uncomfortable and out of line with the axis of rotation. The concurrent use of a two part mandibular cervical collar allows the hinge section of the PFD to remain relatively thin, i.e. constructed of only fabric. This allows the eccentric ballast component to be located on the lower portion 54 of the PFD where it does not impact face plane angle. This fabric hinge also allows the wearer of a PFD that flexes easily and optimally to align the head and neck along the axis of rotation. It is also preferred that the cephalic splint can be worn loose or disconnected until needed. In this way the cephalic restraint PFD acts and feels like a C02 detonator activated Life Jacket, the wearer remains comfortable and unconfined until the gravity of the situation places a priority on airway protective efficacy over and above wearer comfort, such as when one is preparing to abandon their vessel. Alternatively, with a PFD of solid foam construction FIG. 5 the solid foam is notched 60 to reduce the amount of material on both sides of the neck allowing the posterior portion of the PFD to flex rearward allowing the head to align with the axis of rotation. Additionally the posterior cervical portion of the PFD is sculpted to complement the back of the neck, 64 and the anterior portions 62, 63 are cast to complement the curve of the wearers neck as well as the angle of the axis of rotation 10. It is preferred that at least one or two layers of foam cross the hinge section.

In order to contain costs a manufacturer may prefer to not sew the external fabric of the PFD to the entire perimeter of the over sized base layer of foam as preferred. In such case, through sewing at this hinge 56 ties the foam and the fabric into a structural whole. The structural integrity serves two purposes, primary being the efficient transfer of the force generated by the eccentric buoyancy on one side and the force generated by the eccentric ballast on the other so that these forces summate in generating the strongest torque possible per given force. As testing evolves to become more reflective of the real world events that transpire in a PFDs responsibilities in rescuing an unconscious man overboard, (i.e. as stationary tests are developed that eliminate tester's unwitting contribution to PFD performance) and as testers begin wearing clothing other than bathing suits which is more reflective of actual conditions confronting them in water PFD rescue, every design element must be optimized if the PFD is to achieve at least satisfactory or sufficient airway protective righting. Secondly, as PFDs age, the fabric is the first to feel the effects of sun, salt, chemicals and use. As the fiber loosen the fabric increases in laxity and any discontinuous elements rotate about each other rather than effectively transfer their energy into rotating the victim. When the fabric and foam are structurally tied together 56 the fabric gains from its connection to foam that is both protected from the elements as well as not constructed from fibers inclined to unravel or loosen.

Figure 4:
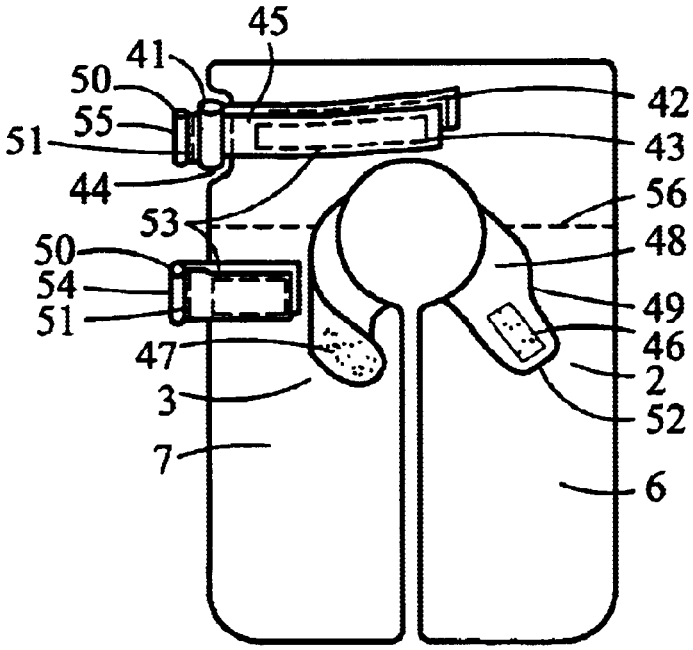
FIG. 4 is anterior view of an integrated fixed eccentric ballasted PFD with incorporated Cephalo-cervical restraint means.

Additionally disclosed is the attachment means for securing the fixed eccentric ballast within the bodice of the PFD FIG. 4. The ballast is securely threaded onto webbing 45 that is bar tacked closed 51. The individual arms of the webbing 42, 43 are then sewn 53 and or glued to the adjacent layers of foam selected for attachment. Lastly the layers of foam are completely glued together. Ideally the remainder of the PFD foam elements are glued when indicated creating a structural integrity within the PFD so that the eccentric buoyant 6 and ballasting forces 5, 41 are acting with optimal efficiency about the same axis of rotation 10.

Figure 3:
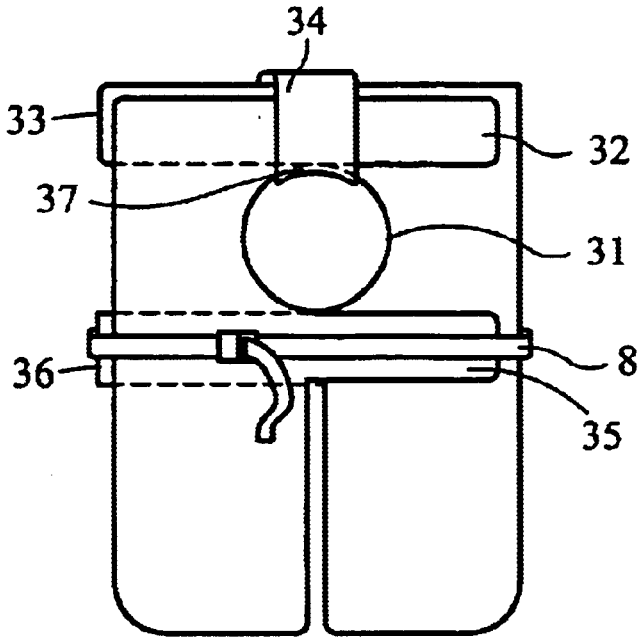
FIG. 3 is a frontal view of a two part, variably sized, yoke collar PFD with overlapping anterior and posterior cervical arms providing a wide variation in neck sizing.

Also disclosed is an alternate means of controlling a flaccid neck and head, by a dual interlocking PFD, (FIG. 3) that overlaps behind and in front of the victim's neck. An eccentric shaped opening 31 allows the shape of the enlarging opening to remain circular as the diameter increases. The overlapping top pieces 32, 33 slide within a common sleeve 34 so that they are retained in position and the overlap beneath the chin is reduced by the wearer through tightening the straps 8 that encircle the PFD and compress its buoyancy about the wearers thorax. Dual straps increase both the rigidity of the two part PFD and improve the capacity of the PFD to remain attached as well as in position upon a limp wet victim in a riled sea state. For the individual that has to drop a distance from a vessel into the water or an individual who has to spend any length of time at sea before rescue, a crotch strap 12 (FIG. 1), is an irreplaceable component of any PFD in order to prevent the flaccid victim from slipping down if not out through the bottom of the PFD.

Thus, the present invention provides an integrated or attached (built in or retrofitted) space occupying (fills space beneath the chin) cephalic restraint collar (holds the head in the axis of rotation) for improved life jacket performance. The current invention assists with aligning and securing the head and neck in line with the axis of rotation. In this position the ballast of the head is divided evenly about the axis of rotation negating its ability to oppose effective rotation.

The cephalo-cervical restraint improves the efficacy of all PFD designs elements targeting turning. By guiding the head into the cylindrical notch in the posterior cervical foam behind the victim's head the head is them aligned along the axis of rotation where the heads 14–17 pounds of ballast is symmetrically distributed about that axis. Therefore, whatever eccentric forces are applied in the generation of angular acceleration or torque, do not have to overcome the offsetting effects of the heads ballast acting as a mobile ballast element. Preferably, the collar has soft inner fabric for comfort and warmth.

The inflatable and foam collar embodiments provide mandibular support (anterior superior range of motion) and bracketing (side to side motion). The collar embodiments can be used as ballistics collar PFD, which previously had no turning requirements by UL or USCG. When used as a ballistics collar PFD, especially as an inflatable collar, the cephalic restraint serves to create a new level of turn performance for an unconscious victim wearing 20–30 lbs. of ballistics protection.

The inner layer can be a loose fiber, the next layer a soft conforming foam, the outer layer a stiffer foam such as used in the PFD. Together the two sides interlock allowing sufficient comfort yet setting a firm limit to the head's range of motion. The collar can be further modified to include a mandibular portion that lays along the victim's jaw then seeps under the chin. The cephalo-cervical restraint allows the PFD to be uniquely and perfectly sized, aligns the head for rotation and prevents the victim from slipping out or down within the PFD.

Figure 10:
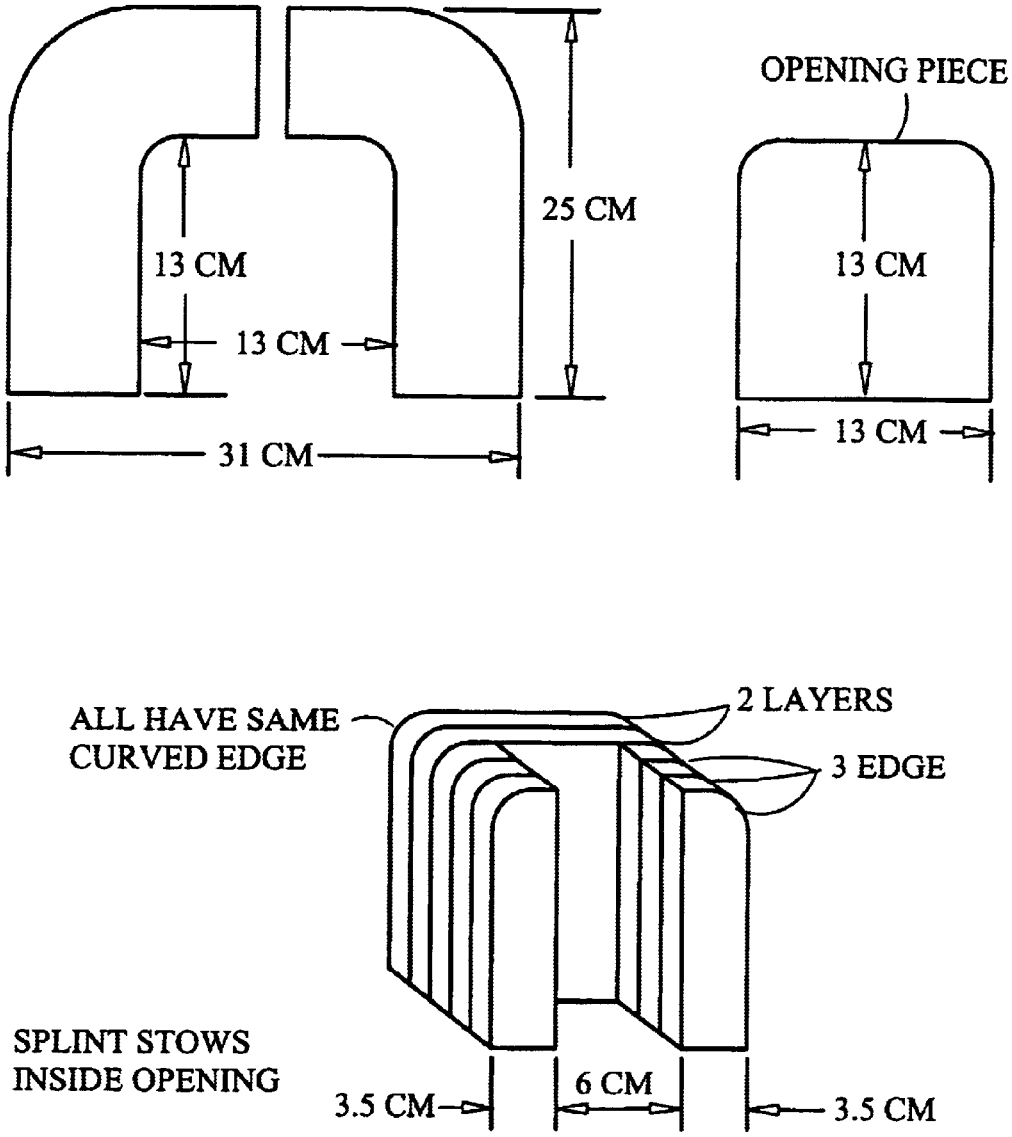
FIG. 10 is an anterior view illustrating the components cervical collar components, the neck opening and the construction of a mandibular splint that can be stored with the neck opening of the PFD collar.

The cervical collar pieces illustrated in the upper left hand corner of FIG. 10 are seen to preferably join behind the head. This joint allows flexion upon opening so that the head can easily pass through the PFD's neck opening. The right and left half of the cervical collar form the neck opening which is identified in the upper right hand drawing as preferably being approximately 13 cm by 13 cm. However, the invention is not limited to any specific dimensions and all possible dimensions are considered within the scope of the invention. Since storage is such a premium on cruise liners which often carry two or three sets of PFDs per passenger for 5,000 passengers per cruise, the use of the neck opening to store the cephalo-mandibular restraint splint allows current lockers to be used without modification.

In detail the mandibular splint can be constructed of layers of closed cell foam creating a convexity that surrounds the larynx allowing support along the entire jaw line without compressing the voice box or airway. Other materials can be used, such as, but not limited to, fibers and open cell foam, and are also considered within the scope of the invention.

Though the invention is primarily discussed with use of foam type PFDs, it should be recognized, that the various embodiments of the present invention can also be used with inflatable type PFDs, and such use is also considered within the scope of the invention. Furthermore, the various restraint devices, though shown in foam configuration, can also be provided in inflatable configurations, and such uses are also considered within the scope of the invention. Thus, an independent inflatable cephalic restraint means can be provided with a self closing self locking collar.

Index of Components

1 Cephalo-mandibular space occupying restraint means (space occupying function of cephalic restraint/mandibular splint)
2 Variable length left overlapping component of cephalo-restraint means
3 Right component of cephalo-cervical restraint
4 Sculpted depression within the posterior cervical foam of PFD receiving the nape of the victim's neck.
5 Right eccentric ballasted illumination/signaling means
6 Left ventral eccentric buoyant means
7 Right ventral arm of Yoke Collar style PFD
8 PFD attachment strap
9 Water entry victim
10 Axis of rotation of unconscious victim
11 Head held firmly in alignment with axis of rotation
12 Crotch strap
13 Loose woven means locating specific attachment site for additional ballast
14 WARNING symbol advising against attachment of ballast on the PFD's eccentric buoyancy side
21 Flaccid neck allows head to roll forward and down while wearing a traditional PFD allowing the nose and mouth to submerge beneath the waterline.
31 Variable sized neck opening, can be reduced to specific size of victim donning the PFD.
32 Forward component of the posterior cervical adjustable overlapping arms of PFD
33 Rear component of the posterior cervical adjustable overlapping arms of PFD
34 Retaining means allowing the rear and forward components to slide over one another, adjusting their position with out separating.
35 Forward component of anterior cervical adjustable overlapping arms of PFD
36 Rear component of anterior cervical adjustable overlapping arms of PFD
37 Eccentric bilateral curve of adjustable circumferential cervical opening
41 Integrated Fixed eccentric ballast means
42 Attachment means for integrated ballast, sewn & glued to inferior foam layer
43 Attachment means for integrated ballast, sewn & glued to superior foam layer
44 Notch in foam layer enclosing fixed eccentric ballast
45 Webbing for securing internal or external ballast to foam and fabric of the PFD
46 Variable position secure attachment means for left component of cephalic restraint
47 Variable position secure attachment means for right component of cephalic restraint
48 Mandibular portion of left cephalic restraint
49 Mandibular cervical notch in left arm of cephalic restraint
50 Hinge means for mounting external eccentric ballast component, accessible outside fabric shell for reversibly attaching ballast or signaling/illumination device.
51 Bar tack isolating internal from external ballast elements
52 Cervical portion of left cephalic restraint
53 Stitching attaching ballast retaining means to foam layer
54 Independent external attachment means
55 Mobile secondary external ballast attachment hinge means a continuation of the fixed internal ballast attachment means
56 Through sew line at PFD cervical hinge zone structurally connecting fabric and foam
60 Bilateral mid-cervical hinge cast into the solid foam during construction.
61 Posterior cervical portion of PFD
62 Superior aspect of overlapping arm 35 cylindrically and angled to position neck along axis.
63 Superior aspect of overlapping arm 36 cylindrically sculpted and angled to position neck along axis.
64 Posterior portion of PFD cervical foam cylindrically and angled to complement back of the neck along the rotation
70 Hollowed cavity created by solid cephalo-mandibular splint
71 Mandibular support surface
72 Solid cephalo-mandibular splint
73 Loose arm of fabric shell used to attach solid splint to body of PFD
74 Attachment site between cephalo-mandibular splint and closure means to body of PFD
75 Overlapping flap attached on opposite side
76 Variable closure means for adjusting size of neck opening and securing splint to PFD wearer.
77 Overlapping left closure means with outward facing variable attachment means VELCRO fasteners TM
80 Compact cephalo-mandibular restraint stowed within PFD neck opening
81 Loose fabric attachment means for compact splint allowing adjustable positioning
83 Left fabric flap for securing compact splint
84 Variable closure means to adjusting position of compact splint to wearer anatomy
85 Right fabric securing means for compact splint
86 Variable attachment means for adjusting size of neck opening of PFD to individual anatomy.
87 Cervical notch in compact splint to locate and accommodate wearer's chin
88 Fabric hinge area of PFD free of foam
90 Horizontally mounted cephalo-mandibular restraint stowed compactly against ventral arms of PFD 91 Right loose hinge to accommodate opening arms of PFD during donning as well as final customized positioning of cephalo-mandibular restraint.

92 Left loose hinge to accommodate opening arms of PFD during donning as well as final customized positioning of cephalo-mandibular restraint.

93 Left variable closure means for securing splint in exact position to accommodate individual anatomy 94 Left complementary variable closure means for securing splint exact position to accommodate individual anatomy 95 Right variable closure means for securing splint in exact position to accommodate individual anatomy 96 Right complementary variable closure means for securing splint in exact position to accommodate individual anatomy 97 Right lower volume ventral buoyant means 98 Left higher volume/eccentric buoyant means 99 Notch in horizontally mounted cephalo-mandibular restraint to locate and stabilize the wearer's chin Some of the features and characteristics of the present aligned include, but are not limited to, the following:

1 A space occupying cephalic restraint means integrated into PFD.

2 An adjustably sized PFD capable of being individually tailored to a wide range of different neck sizes, quickly, while in the field.

3 Adjustably sized mandibular—cervical space occupying collar built into PFD.

4 One, two or more over lapping collars that in total depth fills the posterior to anterior space beneath the mandible supporting the jaw from falling forward or to the side.

5 Solid foam mandibular splint sculpted to provide protected space to allow unobstructed breathing and swallowing 6 Variable closure means for securing adjustably sized cephalic restraint.

7 Fiber filled cephalic restraint collar.

8 Open cell foam filled cephalic restraint collar.

9 Closed cell foam filled cephalic restraint collar.

10 Distinct mandibular and cervical portions of cephalic restraint.

11 Dual layer construction mandibulo-cervical collar, inner layer soft moldable padding and outer more rigid foam structure.

12 Stretchable element in covering allowing cephalic restraint to be adjustably tensioned.

13 The anterior face of the posterior PFD foam neck portion, cylindrically sculpted to receive, align and cradle the wearer's neck.

14 Adjustable overlapping posterior foam portion of PFD.

15 Retaining means to keep overlapping posterior portions aligned and contiguous.

16 Adjustable overlapping anterior portion of PFD.

17 Combined adjustable and overlapping posterior and anterior portions of PFD constructed of solid foam or foam layers.

18 Internal ballast element housed in notch within the PFD foam body.

19 Internal ballast secured by retaining means secured to one or more foam layers.

20 External ballast attachment means secured to one or more foam layers.

21 External ballast attachment means constructed from a continuation of the internal ballast attachment means.

22 Two part cephalic restraint means that can be attached in field to existing PFDs to retrofit with reliable surface airway protection.

23 One or more part inflatable cephalic restraint means built in during construction to the inherently buoyant PFD, creating a hybrid PFD with single surface position.

24 Independent inflatable cephalic restraint means that attached in the field to existing PFDs.

25 Loose woven patch identifying the specific site for attachment of any device to the PFD to augment turning torque.

26 International WARNING symbol informing wearer to not attach light/ballast on the side designed and constructed to be the source of the eccentric buoyant driving force.

27 Notched hinge section built into the mold for a solid foam PFD.

28 Complementary sculpted cylindrical depressions built into the posterior and anterior cervical sections of the mold for casting of a solid foam PFD.

29 Compact Cephalo mandibular splint sized to stow within neck opening of PFD.

30 In PFDs with complete separation between posterior cervical collar and ventral arms internal or external ballast is ideally attached to the right ventral arm.

31 Horizontally mounted adjustably sized compact cephalo-mandibular restraint stows flush against the ventral buoyant means of the PFD.

32 Horizontally mounted adjustably sized compact cephalo-mandibular restraint with notch to locate and accommodate the wear's chin.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A restraint device for aiding a personal flotation device's ability to roll wearer from an airway submerged position to an airway protected position, said device comprising:

a restraint adjustable in neck opening size to snugly engage a wide range of different wearer neck sizes, said restraint substantially filling the area beneath the chin of the different neck size wearers for maintaining the head of the different neck size users in a desired position once the restraint has been properly sized and positioned to a wearer's neck size, said restraint adapted for secured positioning within or adjacent to a neck opening of a personal flotation device;

wherein said restraint includes a cephalo-mandibular splint;

wherein said splint is disposed within a cover;

wherein said cover is releasably attached to the personal flotation device.

2. A restraint device for aiding a personal flotation devices's ability to roll wearer from an airway submerged position to an airway protected position, said device comprising:

a restraint adjustable in neck opening size to snugly engage a wide range of different wearer neck sizes, said restraint substantially filling the area beneath the chin of the different neck size wearers for maintaining the head of the different neck size users in a desired position once the restraint has been properly sized and positioned to a wearer's neck size, said restraint adapted for secured positioning within or adjacent to a neck opening of a personal flotation device;

wherein said restraint comprises:

a first flap member adapted for attachment to the personal flotation device, said first flap member including a first stiff member disposed within;

a second flap member adapted for attachment to the personal flotation device, said second flap member including a second stiff member disposed within, said second flap member adjustably secured to said first flap member based on the neck size of the wearer.

3. The restraint device of claim 2 wherein said first flap member is adapted for removable attachment to the personal flotation device at or adjacent to the neck opening of the personal flotation device and said second member adapted for removable attachment to the personal flotation device at or adjacent to the neck opening of the personal flotation device.

4. A restraint device for aiding a personal flotation device's ability to roll wearer from an airway submerged position to an airway protected position, said device comprising:

a restraint adjustable in neck opening size to snugly engage a wide range of different wearer neck sizes, said restraint substantially filling the area beneath the chin of the different neck size wearers for maintaining the head of the different neck size users in a desired position once the restraint has been properly sized and positioned to a wearer's neck size, said restraint adapted for secured positioning within or adjacent to a neck opening of a personal flotation device;

wherein said restraint includes a cephalo-mandibular splint; and a first flap member adapted for attachment to the personal flotation device and a second flap member adapted for attachment to the personal flotation device, said second flap member adjustably secured to said first flap member based on the neck size of the wearer for proper positioning of said splint.

5. The restraint device of claim 2 wherein said first flap member is adjustably secured to said second flap member in an overlapping relationship through a first hook and loop fastening member disposed on said first flap member and a complementary second hook and loop fastening member disposed on said second flap member.

6. The restraint device of claim 4 wherein said first flap member is adjustably secured to said second flap member in an overlapping relationship through a first hook and loop fastening member disposed on said first flap member and a complementary second hook and loop fastening member disposed on said second flap member.

7. A restraint device for aiding a personal flotation device's ability to roll wearer from an airway submerged position to an airway protected position, said device comprising:

a restraint adjustable in neck opening size to snugly engage a wide range of different wearer neck sizes, said restraint substantially filling the area beneath the chin of the different neck size wearers for maintaining the head of the different neck size users in a desired position once the restraint has been properly sized and positioned to a wearer's neck size, said restraint adapted for secured positioning within or adjacent to a neck opening of a personal flotation device;

wherein said restraint includes a horizontally mounted elongated relatively stiff member adapted for attachment to the personal flotation device at a first location and adapted for vertical and horizontal adjustable securement to the personal flotation device at a second location;

wherein said stiff member includes a chin positioning notch for receiving and supporting at least a portion of the wearer's chin when said restraint is in use.

8. A restraint device for aiding a personal flotation device's ability to roll wearer from an airway submerged position to an airway protected position, said device comprising:

a restraint adjustable in neck opening size to snugly engage a wide range of different wearer neck sizes, said restraint substantially filling the area beneath the chin of the different neck size wearers for maintaining the head of the different neck size users in a desired position once the restraint has been properly sized and positioned to a wearer's neck size, said restraint adapted for secured positioning within or adjacent to a neck opening of a personal flotation device;

wherein a cervical posterior, portion of the personal flotation device is sculpted and angled to receive and complement the back of the wearer's neck substantially along an axis of rotation for the wearer.

* * * * *